United States Patent [19]

Hasenkamp

[11] Patent Number: 4,930,329

[45] Date of Patent: Jun. 5, 1990

[54] INSTALLATION FOR PRODUCING METAL GIRDERS

[75] Inventor: Friederich Hasenkamp, Nettetal, Fed. Rep. of Germany

[73] Assignee: Maschinenbau Gerold GmbH & Co. KG, Nettetal, Fed. Rep. of Germany

[21] Appl. No.: 249,969

[22] Filed: Sep. 27, 1988

[30] Foreign Application Priority Data

Oct. 28, 1987 [DE] Fed. Rep. of Germany ..... 3736394

[51] Int. Cl.[5] ..... B21D 11/02

[52] U.S. Cl. ..... 29/897.35; 29/155 R; 72/319; 72/323; 228/173.6

[58] Field of Search ..... 72/319, 323; 29/155 R; 228/173.6, 173.7, 6.1

[56] References Cited

U.S. PATENT DOCUMENTS

| | | | |
|---|---|---|---|
| 3,199,175 | 8/1965 | Wögerbauer | 29/155 R |
| 3,260,438 | 7/1966 | Bergantini | 228/6.1 |
| 3,300,839 | 1/1967 | Lichti | 228/173.6 X |
| 3,595,061 | 7/1971 | Bessbo | 72/319 X |
| 4,750,663 | 6/1988 | Warczak | 29/155 R X |

*Primary Examiner*—Mark Rosenbaum
*Assistant Examiner*—Peter Dungba Vo
*Attorney, Agent, or Firm*—Pearne, Gordon, McCoy & Granger

[57] ABSTRACT

An installation for producing girders for building or the like uses a pair of clamping and bending units to clamp and bend strip material in incremental steps to provide shaped strip with a castellated profile used as a web. The pre-shaped strip material used as the web is then welded to further strip material which forms a longitudinal flange of the girder.

9 Claims, 4 Drawing Sheets

INSTALLATION FOR PRODUCING METAL GIRDERS

BACKGROUND TO THE INVENTION

1. TECHNICAL FIELD OF THE INVENTION

The present invention relates to a method of, and an installation or plant for, producing metal girders or like articles having at least one longitudinal flange welded to a web disposed perpendicular to the flange.

2. DESCRIPTION OF PRIOR ART

It is known, for example from German Utility Model No. 8600280.5, to construct a girder for use in building from metal strip material and to weld such strip material together so that a web extends between a pair of parallel flanges. Prior to welding, the strip material which is to form the web is treated to bent it into a profile with trapezoidal portions. In this known method, the shaping of the web takes place separately and the pre-shaped strip may need to be stored.

A general object of the invention is to provide an improved method and installation in which a girder of the aforementioned kind can be produced continuously and automatically. A further object of the invention is to provide apparatus with which strip material intended as the web of a girder is simply and reliably bent to shape immediately before welding.

SUMMARY OF THE INVENTION

An installation constructed in accordance with the invention is intended to produce girders with at least one flange and a web perpendicular thereto. The installation employs shaping apparatus for shaping strip material continuously in incremental steps to produce shaped strip with a non-planar configuration e.g. castellated with trapezoidal portions, used to form the web and a welding station for welding the shaped strip to further strip material used to form the flange. The shaping apparatus may comprise a pair of clamping units equipped with jaws for selectively clamping the strip material at two zones spaced apart along the strip material, means for subjecting the region of the strip material between the clamping units to deformation force directed transversely of the plane of the strip material, and means permitting relative displacement of the clamping units as said region of the strip material becomes shortened by the deformation means.

The invention also provides a method of pre-treating strip material providing the web to create a shaped profile prior to welding; said method comprising clamping strip material at two zones spaced apart along the strip material, subjecting the region of the strip material to deformation force transversally of the plane of the strip material whilst supporting the region and permitting the clamped zones to move together as the length of the region is shortened by the deformation.

The strip material used in the installation can be drawn off from coils and a collecting station can be provided between the welding station and the shaping apparatus where the shaped strip and the further strip material are brought together. The shaped strip and the further strip can be brought together in separate lengths which may require interrupting the incremental advance of the shaped strip.

The installation enables girders to be manufactured in an efficient manner since the pre-shaping of the web is carried out as a process step in the overall production and not separately and there is no necessity to store the pre-shaped strip.

The shaping apparatus may have a pair of relatively displaceable clamping and bending units which are spaced apart in the longitudinal direction of the strip material, said units co-operating to clamp the strip material selectively and to bend a region of the strip material between the units. In a practical construction each clamping and bending unit comprises a pair of jaws which are relatively moved together and apart to clamp and release the strip material and a bending jaw which is displaced separately, e.g. pivoted, to deform and bend said region of strip material.

Preferably, a movable support jaw is provided between the bending and clamping units for supporting said region of strip material during bending. The shaping apparatus is thus able to perform a series of successive bending operations on the strip material so that the latter can advance incrementally and the pre-shaped strip is presented to the collecting station. The movements of the various jaws can be adjusted to permit variation of the shaped profile and to facilitate the incremental advance of the shaped strip. A high degree of accuracy can be achieved in the bent strip and this avoids the need for further deformation subsequently. Furthermore, the shaping can be carried out without subjecting the strip to unnecessary stress or damage. Preferably the jaws are removable replaceable items with rounded edges to avoid deep drawing or damage to the strip. The components of the shaping apparatus undergo far less wear than with rollers or the like and the movement and shape of the jaws can be altered to provide different sizes and profiles for the bent strip. Girders of different size can thus be produced without extensive modification to the plant.

To take up the necessary shortening of the strip during shaping, preferably the unit which receives the strip first is freely displaceable towards the other unit which is held fast. A spring or some other device can then restore the unit back to its take-up position.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
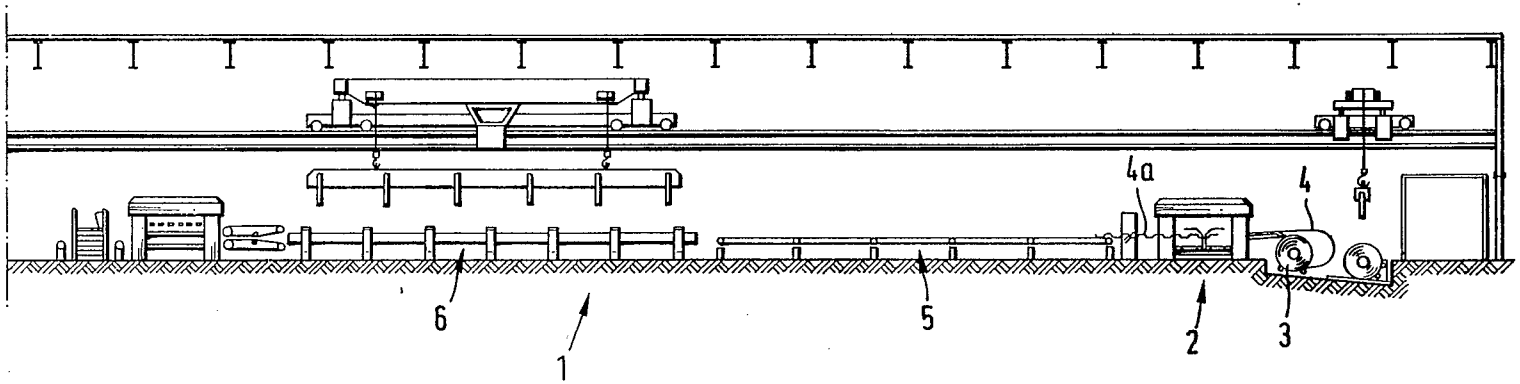
FIG. 1 is a schematic side view of a plant used for the production of girders in accordance with the invention.

As shown in FIG. 1, a plant or installation 1 serves for the continuous production of girders of the type having at least one flange with a trapezoidally corrugated web welded to the flange and extending substantially perpendicular thereto. The plant 1 employs a shaping apparatus 2, described in more detail hereinafter, which takes in strip material 4 stored as a coil 3. The shaping apparatus 2 imparts a castellated profile with trapezoidal regions to the strip 4 and the thus-shaped strip 4*a* is passed into a collecting station 5 where further strip material which form the flange or flanges of the girder are brought together with pre-shaped strip 4*a* forming the web of the girder. In the case where the girder has two parallel flanges the strip 4*a* providing the web is welded between the flanges. The web is welded to the flange or flanges in a welding station 6 which produces one or more continuous welded joints between the strip components.

Figure 1A:
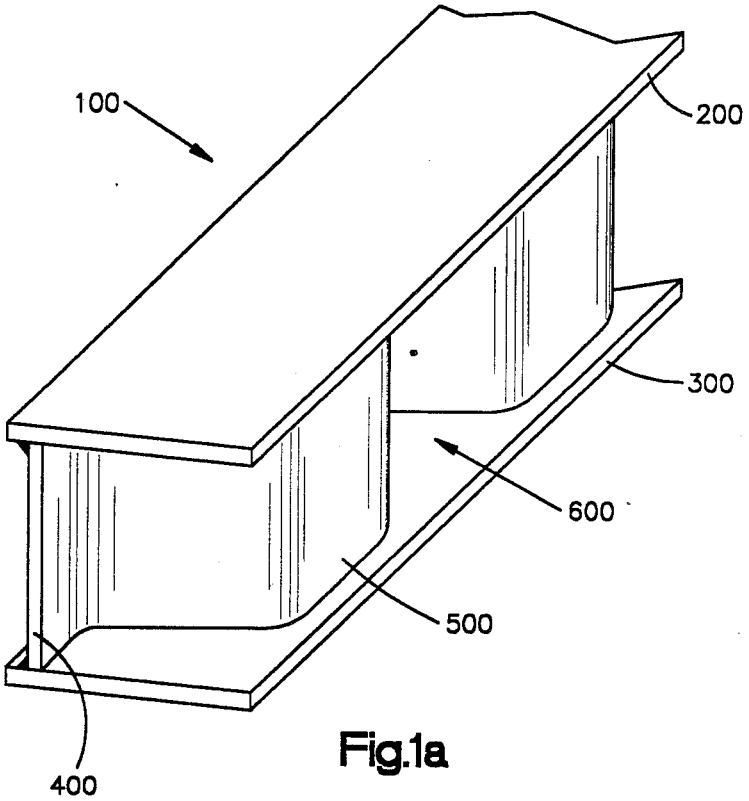
FIG. 1*a* is a perspective view of a girder in accordance with the invention.

A girder 100 made in accordance with the invention is shown in FIG. 1*a*. The girder 100 includes an upper flange 200 joined to a lower flange 300 by a pre-shaped web 400 having castellated trapezoidal regions 500 and 600. The girder 100 has a longitudinal axis extending in the direction of its major dimension, the flanges 200, 300 and web 400 extending therealong.

Figure 2:
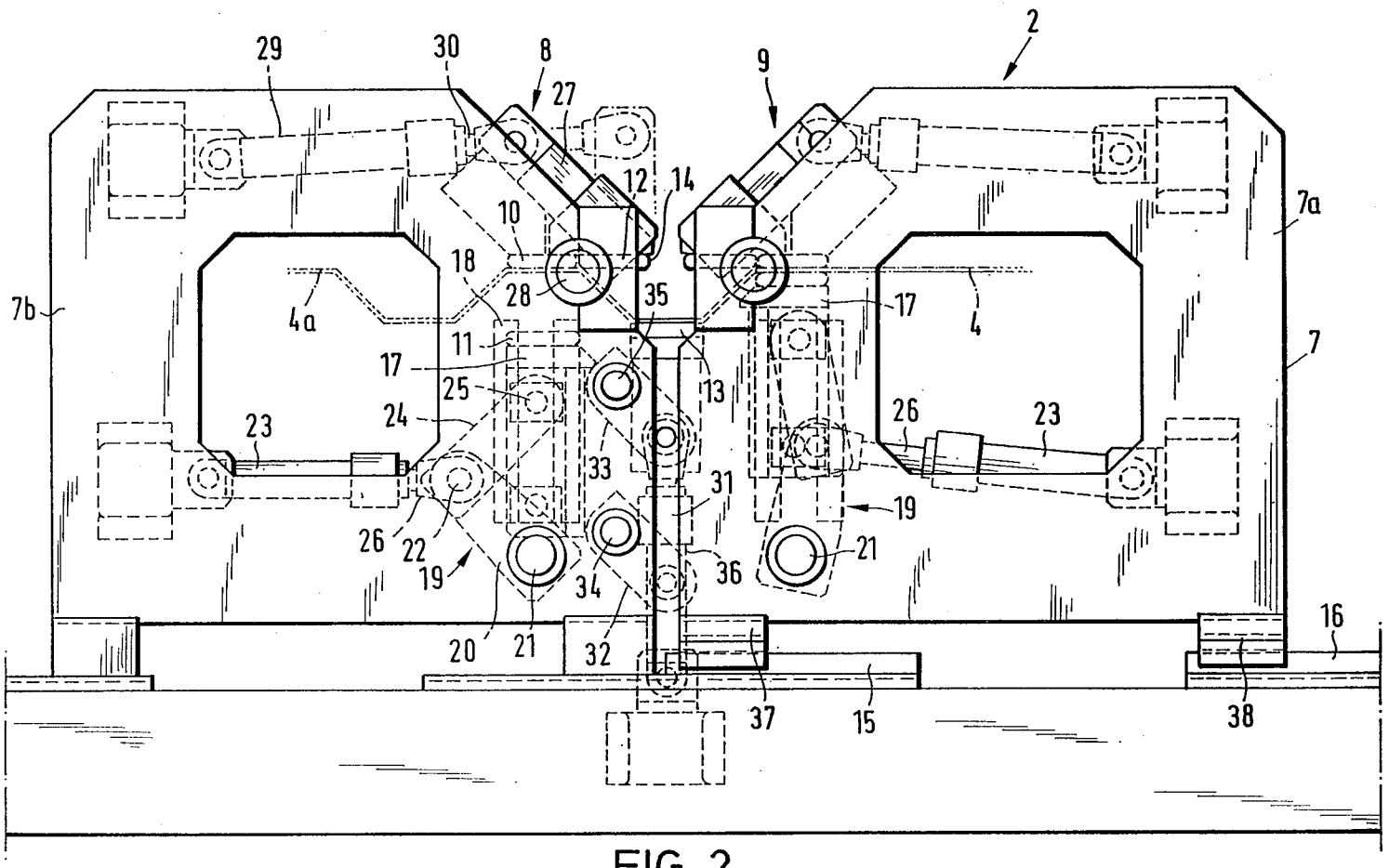
FIG. 2 is a schematic side view of shaping apparatus used in the plant and constructed in accordance with the invention, the view being taken on a somewhat larger scale to FIG. 1.

As shown in FIG. 2, the shaping apparatus 2 has a rigid heavy frame 7 with side walls between which two clamping and bending units 8, 9 are mounted. Each of the units 8, 9 has a pair of relatively movable clamping jaws 10, 11 located one above the other and a pivotable bending jaw 12. A support jaw 13 is disposed between the units 8, 9 and is displaceable in a direction perpendicular to the direction of movement of the strip 4. The various jaws 10, 11, 12, 13 each have a flat removable plate which contacts the strip 4 during the shaping process and the plates have rounded edges 14 to avoid damaging the strip during shaping. The frame 7 is subdivided into sections 7*a*, 7*b* and the frame section 7*a*, at the right of FIG. 2 which forms the inlet for the strip 4 to be shaped is displaceably mounted with slide blocks 37, 38 engaged on rails 15, 16. The frame section 7*a* can thus be displaced in the direction of the feed of the strip 4 in relation to the frame section 7*b* at the left of FIG. 2 which forms the outlet for the shaped strip 4*a*. The section 7*a* is able to move freely along the rails 15, 16 towards the frame section 7*b* to follow the shortening of the strip 4 when the latter is being deformed to shape. To restore the frame section 7*a* back to its initial position a spring or some other device (not shown) can be provided so that the frame section 7*a* moves back and forth in a reciprocal fashion as the strip 4 is shaped.

The upper jaw 10 of each unit 8, 9 is fixed to the side walls of the frame sections 7*a*, 7*b* while the lower jaw 11 is moveable towards and away from the upper jaw 10. Each lower jaw 11 is mounted to a slide or carriage 17 supported between vertical guide rails 18 and an actuator 19 serves to displace the slide 17 up and down along the rails 18. Each actuator 19 has a pair of levers 20, 24 pivotably connected at a common joint 22 connected to the piston rod of an hydraulic ram 23. The lower lever 20 is pivotably connected at its lower end to a pin 21 fixed to the respective frame section 7*a*, 7*b* while the upper lever 24 is pivotably connected at its upper end to a pin 25 fixed to the slide 17. The cylinder of the ram 23 is pivotably connected to the respective frame section 7*a*, 7*b*. If the piston rod of the ram 23 is extended, as represented at the right hand side (frame section 7*a*) of FIG. 2, then the slide 17 is raised to bring the jaws 11 into a disposition close enough to the associated jaw 10 to effect clamping of the region of the strip 4 between the jaws 10, 11. On retraction of the piston rod of the ram 23, the slide 17 is lowered as shown at the left hand side (frame section 7*b*) of FIG. 2, to move the jaw 11 away from the associated jaw 10.

The bending jaw 12 of each unit 8,9 is fitted to a beam 27 which is pivotably mounted on a pivot joint 28 parallel to the direction of movement of the strip 4 and usually horizontal. A hydraulic ram 29 is provided for displacing the beam 27 and thence the jaw 12 to effect bending of the strip 4. The cylinder of the ram 29 is pivotably supported on the respective frame section 7*a*, 7*b* while the piston rod 30 is pivotably connected to the beam 27. Under the action of the associated ram 29 the beam 27 swings around the joint 28 between the positions shown in FIG. 2 is full and chain-dotted lines. In this way the jaws 12 can be urged against the strip 4 to deform and bend the latter.

The support jaw 13 is mounted to an upstanding member 31 which is pivotably connected to a pair of parallel levers 32, 33. The levers 32, 33 are in turn pivotably mounted at their other ends to respective pivot joints 34, 35. The member 31 is guided by the levers 32, 33 for arcuate movement in a near vertical sense and a hydraulic ram 36 is provided for effecting movement of the member 31. The ram 36 is upstanding with its cylinder pivotably mounted to the frame 7 and its piston rod coupled to the pivot joint between the lever 33 and the member 31. The jaw 13 can thus be moved up into contact with the strip 4 prior to bending and lowered as the bending operation takes place to support the strip and assist in its deformation.

Figure 3:
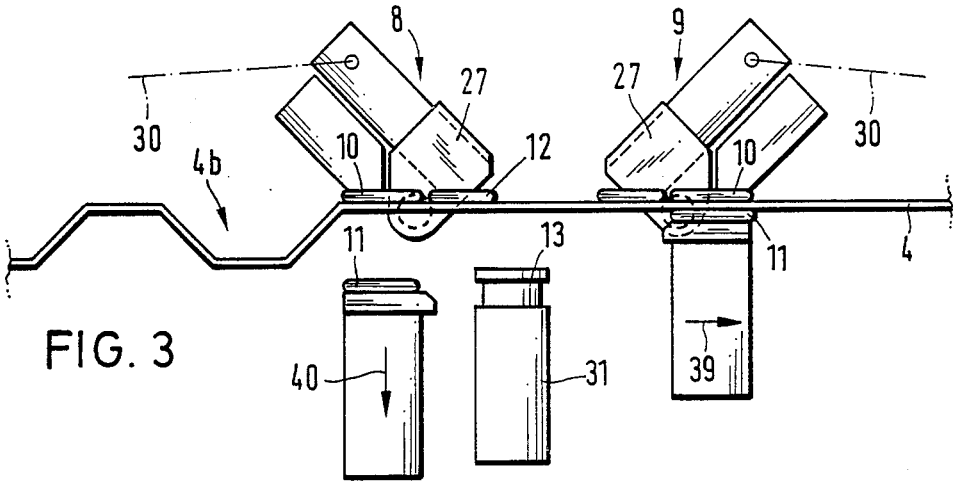
FIGS. 3 to 5 depict clamping and bending units of the shaping apparatus in successive stages of the shaping operation.
Figure 4:
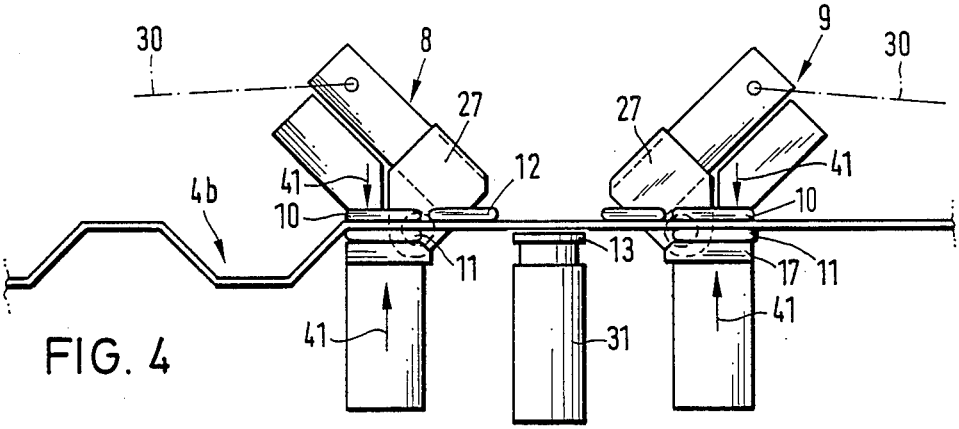
Figure 5:
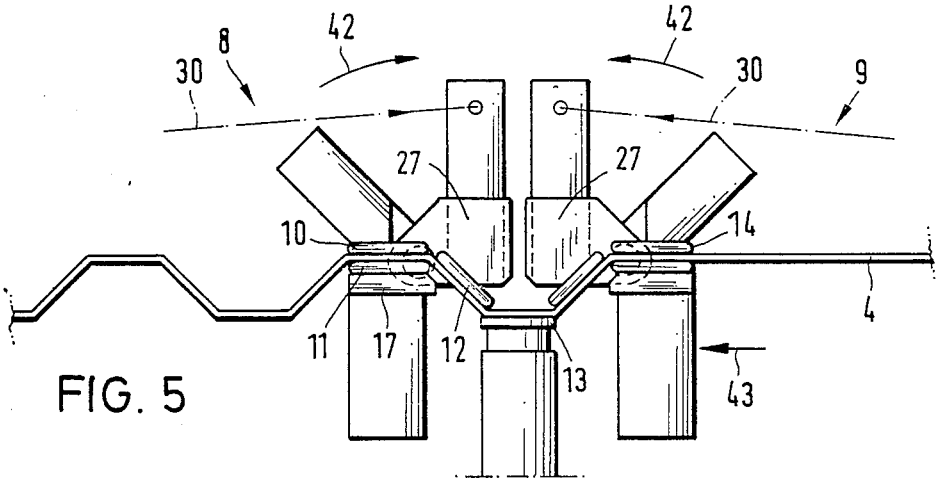

FIGS. 3 to 5 show the components of the bending apparatus during the various stages of the bending operation. The bending units 9 and 8 are respective located adjacent the inlet and outlet ends of the apparatus in accordance with the travel direction of the strip 4. In FIG. 3, the strip 4 is shown with the bent region 4*b* moved to the left from the bending unit 8 so that undeformed flat strip 4 is presented between the units 8, 9. The bending unit 9 has been moved to the right in the direction of arrow 39 to adopt its take up position. The jaws 10, 11 of the unit 9 have been moved apart by a small amount sufficient to clear the strip 4. The lower jaw 11 of the bending unit 8 has been displaced by a greater distance (arrow 40) to allow the passage of the strapezoidally-profiled strip 4*b*. The jaw 13 has also been lowered.

In FIG. 4, the jaws 11 of both units 8, 9 have raised together as indicated by arrows 41 to clamp the strip 4 and the support jaw 13 has also been raised to contact the strip 4. The beams 27 are in the neutral non-operative position.

FIG. 5 depicts the situation after the beams 27 have been pivoted about the pivot joints 28 in the direction of arrows 42 to bring the jaws 12 from a position parallel to the strip 4 into an inclined position to deform the strip 4 as shown. The support jaw 13 is maintained in contact with the underside of the strip while the member 31 is progressively lowered to support the strip as it is bent. The unit 9 is permitted to displace towards the unit 8 in the direction of arrow 43 as the shaped region of the strip shortens. After the strip has been bent in the above-described manner the jaw 11 of the unit 8 and the jaw 13 are moved away and the beams 27 are swung back to adopt the position shown in FIG. 3 whilst the jaw 11 of the unit 9 is moved slightly to permit the unit 9 to be displaced in the direction of arrow 39 FIG. 3 to bring the components back to the position shown in FIG. 3. The strip 4 is then advanced ready for the next cycle.

By changing the jaws and the displacement trajectories shapes other than trapezoidal as illustrated can be imparted to the strip.

We claim

1. An installation for continuous production of girders having a longitudinal axis, at least one flange and a web fixed to the flange and extending generally perpendicular thereto, said flange and web having longitudinal lengths extending along the longitudinal axis of said girder, said installation comprising shaping apparatus for shaping first strip material having a longitudinal length continuously in incremental steps along its length to produce said web with a non-planar configuration and a welding station for welding second strip material which forms said flange to said web, said shaping apparatus including a pair of relatively displaceable clamping and bending units which are spaced apart along the longitudinal length of the first strip material, said units cooperating to clamp the first strip material selectively and to bend a region of the first strip material between the units with relative displacement of the units along the longitudinal length of the strip material, each of said bending units comprising a pair of clamping jaws which are relatively moved together and apart to clamp and release the strip of material and a bending jaw which is displaced separately to deform and bend said region of strip material, one of the jaws of each of said units being supported by a displaceable slide which is moved toward and away from other jaws of said unit with a hydraulic ram for displacement of the displaceable slide.

2. An installation according to claim 1, wherein the first strip material and second strip material are unwound from coils and a collecting station is provided between the welding station and the shaping apparatus where the web and the second strip material are brought together.

3. An installation according to claim 1, wherein the bending jaw is supported for pivotable movement.

4. An installation according to claim 1, wherein the unit which receives the strip material first is displaceable along the longitudinal length of the strip material in relation to the other unit.

5. An installation according to claim 1, wherein the jaws include plates with rounded edges.

6. An installation according to claim 1, wherein the bending jaws are supported by pivotably mounted beams displaced by hydraulic rams.

7. An installation according to claim 1, wherein a support jaw is provided between the bending and clamping units for supporting said region of strip material during bending.

8. An installation according to claim 7, wherein the support jaw is moveable toward and away from the strip material.

9. An installation for continuous production of girders having a longitudinal axis, at least one flange and a web fixed to the flange and extending generally perpendicular thereto, said flange and web having longitudinal lengths extending along the longitudinal axis of said girder, said installation comprising shaping apparatus for shaping first strip material having a longitudinal length and continuously in incremental steps along its length to produce said web with a non-planar configuration and a welding station for welding second strip material which forms said flange to said web, said shaping apparatus including a pair of relatively displaceable clamping and bending units which are spaced apart along the longitudinal length of the first strip material, said units cooperating to clamp the first strip material selectively and to bend a region of the first strip material between the units, each of said bending units comprising a pair of clamping jaws which are relatively moved together and apart to clamp and release the strip of material and a bending jaw which is displaced separately to deform and bend said region of strip material, one of the jaws of each of said units being supported by a displaceable slide which is moved toward and away form other jaws of said unit with guide levers and a hydraulic ram for displacement of the displaceable slide.

* * * * *